US005667145A

United States Patent [19]

Schmidt et al.

[11] Patent Number: 5,667,145

[45] Date of Patent: Sep. 16, 1997

[54] INJECTION NOZZLE

[75] Inventors: Ralph-Michael Schmidt, Langenargen; Christoph Teetz; Martin Rauscher, both of Friedrichshafen, all of Germany

[73] Assignee: MTU-Motoren-Und Turbinen-Union, Friedrichshafen, Germany

[21] Appl. No.: 361,501

[22] Filed: Dec. 22, 1994

[30] Foreign Application Priority Data

Dec. 23, 1993 [DE] Germany ..... 43 44 026.6

[51] Int. Cl.[6] ..... F02M 61/18; F02M 61/14

[52] U.S. Cl. ..... 239/533.12

[58] Field of Search ..... 239/601, 533.12, 239/567

[56] References Cited

FOREIGN PATENT DOCUMENTS

| | | | |
|---|---|---|---|
| 0 246 373 B 1 | 3/1992 | European Pat. Off. . | |
| 2238059 | 2/1975 | France . | |
| 3501236 C1 | 7/1986 | Germany . | |
| 3612029 A1 | 11/1986 | Germany . | |
| 8521912 U | 3/1987 | Germany . | |
| 4205744A1 | 8/1992 | Germany . | |
| 4-272470 | 9/1992 | Japan | 239/533.12 |
| 489 708 | 6/1970 | Switzerland . | |

OTHER PUBLICATIONS

Patent Abstracts of Japan, JP3011152, Jan. 18, 1991, vol. 15, No. 120 (M-1096), 25 Mar. 1991 and JPA03011152 (Mitsubishi Heavy Ind. Ltd.).

*Primary Examiner*—Josie Ballato

*Attorney, Agent, or Firm*—Evenson McKeown Edwards & Lenahan, PLLC

[57] ABSTRACT

An injection nozzle for diesel engines is disclosed with a direct fuel injection into combustion air in the combustion space having a swirl. The nozzle is constructed as a hole-type nozzle with several injection openings arranged at uniform distances and distributed along the nozzle circumference. In order to further develop such an injection nozzle in a manner which permits shorter injection durations and an improved utilization of the air, an additional injection opening with a smaller diameter is constructed in each case between two adjacent larger injection openings, whereby the overall cross-sectional surface of all injection openings becomes larger without any drifting into one another of the thus formed fuel sprays.

13 Claims, 3 Drawing Sheets

INJECTION NOZZLE

BACKGROUND AND SUMMARY OF THE INVENTION

This invention relates to an injection nozzle for diesel engines with a directional injection into a combustion air in the combustion space displaced with a swirl, which injection nozzle is constructed as a hole-type nozzle with several injection openings arranged at uniform distances and distributed along a circumferential arc of the nozzle.

In the case of diesel engines, it is known to inject the fuel into the combustion space in such a manner that, before and during the combustion, it is distributed as uniformly as possible on the total combustion air. In this case, the direct fuel injection according to the spray atomization process is dominant in which the fuel is injected from a multihole nozzle downward into the combustion air in the combustion space, in which case, when this air flows in, it was set into a rotating motion about the cylinder axis as a result of a special shaping of the intake duct. As the result of the rotation of the air, the desired distribution of the fuel takes place on the whole combustion space, thus also on air which does not directly encounter the atomization of the fuel during the injection through nozzle bores.

As the result of this circulating air flow in the combustion space, particularly in the case of combustion processes with a high swirl, the injector sprays will have a strong drift. If the individual drifting sprays overlap in this case, local areas with a fuel excess are formed which burn while lacking oxygen. The consequences of such an incomplete combustion are high emissions of soot.

So that the injection sprays will not drift in an overlapping manner as described, in the case of this form of injection, injection nozzles are used which have a limited number of injection bores whose bore distance is selected such that the individual injection sprays cannot overlap even when there is a strong drift.

An injection nozzle of this type is described in European Patent Document EP-PS 0 246 373 B1 and is described there as a structural component of an overall fuel injection system. In the case of this known injection nozzle, a total of three injection openings are constructed at uniform distances from one another laterally on the circumference of the nozzle body.

According to the position of a valve closing element constructed as a hollow cylinder, the three injection openings are opened or closed and the fuel quantity to be injected is proportioned accordingly. When the injection openings are completely open and the injection pressure is defined, the fuel quantity which can be maximally injected is determined by the overall cross-sectional surface of the three injection openings which have the same size. The above-described overlapping of the injection sprays which are defined by the injection openings and the drifting of these injection sprays as the result of the combustion air swirl are avoided, in this case, because of the angular distance of 120° respectively.

Because of its constructional and functional characteristics explained so far, this known injection nozzle has the disadvantages that, as the result of the few opening surfaces of the injection openings of the same respective diameter, a relatively small overall openings surface and, as a result, relatively long injection durations will be obtained. In addition, the air utilization is low in the case of the combustion operation of this swirling process with the conventional three to five injection openings.

It is therefore an object of the invention to provide an injection nozzle of the initially mentioned type which permits shorter injection durations and/or an improved air utilization while it avoids the above-described disadvantages.

Based on an injection nozzle of the above-mentioned type, these objects are achieved by providing an injection nozzle wherein, between at least two adjacent first size injection openings another second smaller size injection opening is constructed, the mouths of all injection openings being situated on a common circumferential arc.

This alternating arrangement of large and small injection openings, where in each case between two large bores, which were previously constructed also in the case of conventional nozzles of this type, according to the invention, an additional injection opening is provided which has a smaller bore diameter, has the technical advantage that therefore, with a view to the whole injection nozzle, a much larger total cross-sectional surface of all injection openings is achieved on a nozzle than in the case of conventional injection nozzles without any even partial drifting into one another of the resulting injection sprays during the injection into the air swirl.

The thus enlarged total cross-sectional injection surface permits a significantly higher fuel flow than in the case of conventional injection nozzles so that, under conventional injection pressure conditions, the provided fuel quantity can be injected into the combustion space during a much shorter period of time than previously. This shorter injection duration provides the advantage of a shorter combustion duration, whereby the effective specific fuel consumption can be lowered.

Another significant advantage of the construction of the injection opening according to the invention is the correspondingly achieved uniform distribution of the fuel in the air, which leads to a more homogeneous mixing and a resulting much better air utilization in the cylinder. In this case, the combination of small and large injection openings has a particularly advantageous effect because, by means of a constant injection pressure, a finer atomization is basically achieved by means of small injection openings than by means of large openings.

In a further development of the invention, it is provided that the axes of the large and the small injection openings are in each case situated on different concentric cone envelopes whose cone angles differ. As a special advantage of this embodiment, an injection pattern is achieved which excludes within an even higher degree of reliability an overlapping drifting of the injection sprays and, at the same time, promotes turbulent flow conditions for a better swirl of the fuel in the combustion air in the combustion space.

The significantly improved air utilization resulting from the homogeneous mixing and the therefore achieved sequence of the combustion leads to a lower development of soot while the pollutant emissions are otherwise the same.

Other objects, advantages and novel features of the present invention will become apparent from the following detailed description of the invention when considered in conjunction with the accompanying drawings.

DETAILED DESCRIPTION OF THE DRAWINGS

Figure 1:
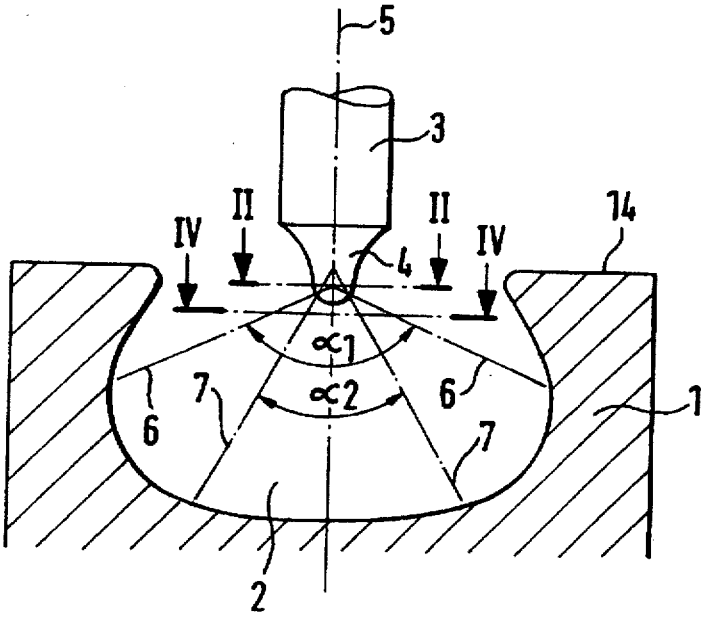
FIG. 1 is a schematic cross-sectional representation of the arrangement of an injection nozzle and a piston combustion space, constructed according to preferred embodiments of the invention.

FIG. 1 is a schematic view of the injection conditions of an internal-combustion engine which is otherwise not shown in detail. Opposite the piston 1, the injection nozzle 4 is arranged coaxially with respect to the center axis 5 of the piston and, together with its nozzle holder, is screwed into the cylinder head in a manner not shown in detail in the drawing.

In contrast to the coaxial arrangement of the injection nozzle illustrated here, any other placing of the nozzle in the cylinder is also possible without impairing the advantages achieved by means of the invention.

The piston 1 has a piston recess 2 which must not necessarily have the shown form but, according to the desired flow conditions, may be constructed in any shape. In FIG. 1, the piston 1 is in its upper dead-center position (OT) in which the upper piston edge 14 is displaced so far in the direction of the injection nozzle 4 that it projects at least partially into the piston recess 2.

The injection nozzle 4, which in this case is constructed as a blind hole nozzle, has several injection openings 8, 9 which are distributed at a distance from the injection nozzle tip on a circumferential line or arc. In this case, the injection openings 8, 9, or more precisely the mouth openings, of these injection openings 8, 9, 15, 16 are situated on the common circumferential line arc, while the axes 10, 17 of the large injection openings 8, 15 constructed as bores are situated on a cone envelope surface 6, while the axes 11, 18 of the small bores 9, 16 are situated on a cone envelope surface 7.

Here, the cone angle $\alpha_1$ of the cone envelope surface 6 is selected to be larger than the cone angle $\alpha_2$ of the cone envelope surface 6. Practical range for the cone angle $\alpha_1$ is $\alpha_2<\alpha_1\leqq(\alpha_2+10)$. In this case, the emerging injection sprays are directed in the direction of the piston recess 2 when the piston is in its upper dead-center position, as illustrated in FIG. 1.

Figure 2A:
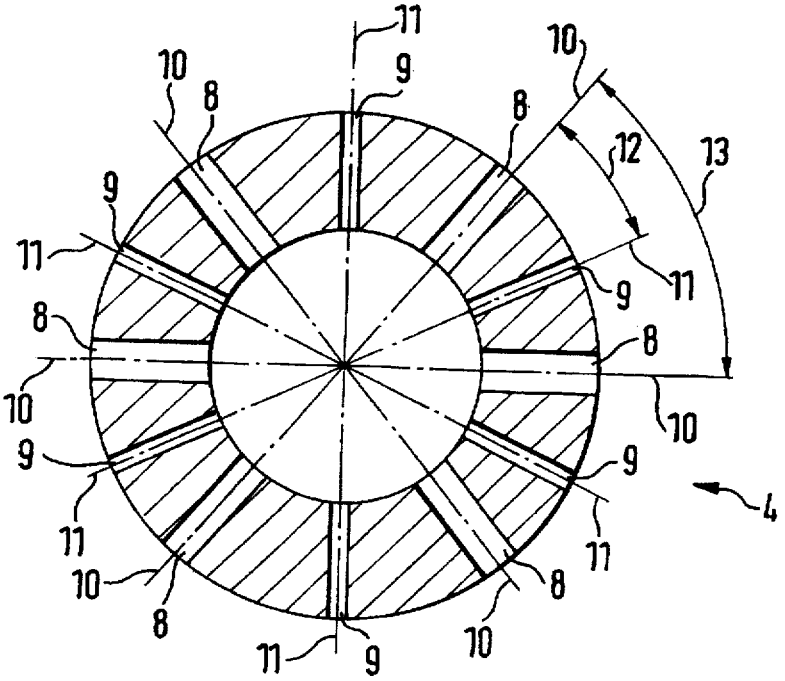
FIG. 2*a* is a horizontal sectional representation of the nozzle along the sectional course II—II in FIG. 1 according to a first embodiment of the invention.
Figure 2B:
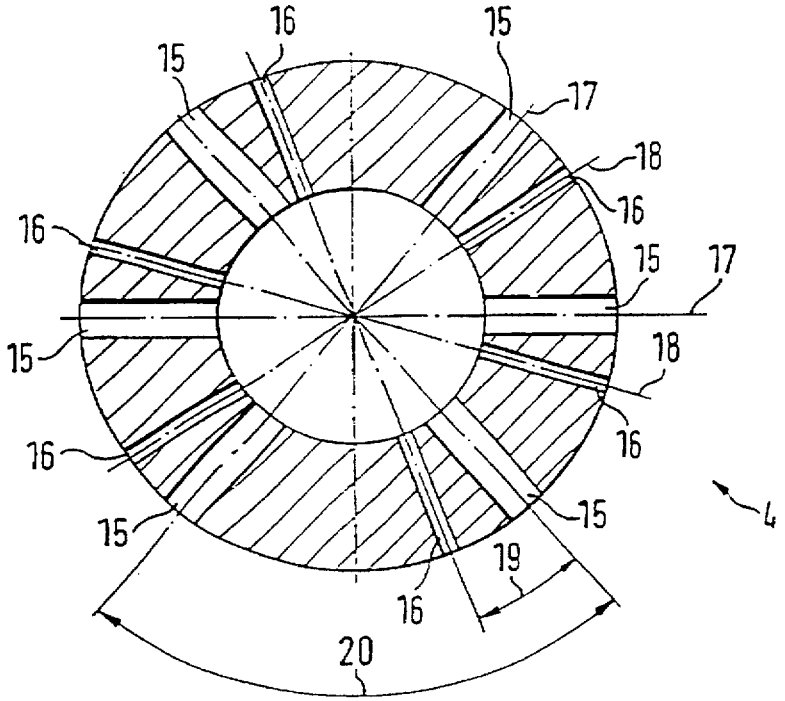
FIG. 2*b* is a horizontal sectional representation of the nozzle along the sectional course II—II in FIG. 1 according to a second embodiment of the invention.

FIGS. 2*a* and 2*b* each show an embodiment of the injection nozzle 4 according to the invention as a sectional view along the sectional course II—II in FIG. 1. These figures each show the respective arrangement of the injection bores 8, 9, 15, 16 on the common circumferential line of the injection nozzle 4. In this case, in the embodiment illustrated in FIG. 2*a*, a total of six injection openings 8 having a large conventional diameter and six additional injection bores 9 having a smaller diameter are arranged at uniform mutual distances distributed along the circumference of the injection nozzle 4. Practical ranges of actual diameters for the nozzels bores 8, 9, 15, 16 are $0.6\,D\leqq d\leqq 0.8\,D$, wherein D is the diameter of first sizes bores 8, 15, and d is the diameter of the second size bores 9, 16.

As indicated in FIG. 2*a*, here one smaller injection opening 9 respectively is arranged between two large injection bores 8, in which case the circumferential angle distance 12, which the axes 10, 11 of a large injection opening 8 and of a small injection opening 9 enclosure between one another, is half the size of the circumferential angle 13 which the axes 10, 10 of two adjacent large infection bores 8 form with one another.

In each case, the injection bores 8, 9, 15, 16 are produced as fine bores in the injection nozzle tip. However, the design of the injection openings 8, 9, 15, 16 is not necessarily limited to the development as a bore but different shapes and designs may also be provided which are suitable for producing desired inflow conditions.

Figure 4:
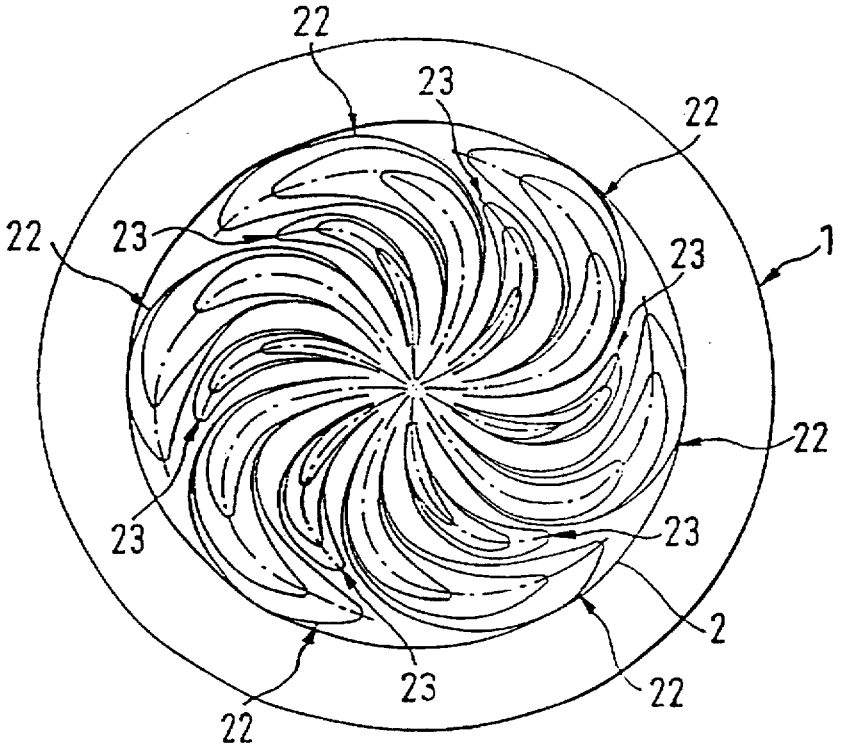
FIG. 4 represents a top view of the injection pattern of the first embodiment of the injection nozzle according to the invention.

In this case, it is significant with respect to the invention that the diameters of the large injection openings 8 and of the small injection openings 9 are dimensioned in such a manner that the fuel flow which forms on the basis of the injection pressure through the individual injection openings 8, 9, 15, 16 can in each case form a spray 22, 23, as illustrated in FIG. 4.

FIG. 4 shows a typical injection spray pattern which forms when several injection sprays 6, 7 shapped in the illustrated embodiments are injected into the combustion space—the piston recess 2. The inflowing combustion air had previously been set into rotation by means of a corresponding inflow duct in such a manner that an air swirl forms in the combustion space. This air, which is provided with a large swirl by means of the special inflow duct called a swirl duct, is normally introduced centrally from above into the combustion space. In this case, the inflowing air pulls the fuel along with it and therefore causes the drafting sprays or injection sprays to drift forming the injection lobes, 22, 23 illustrated in FIG. 4.

Figure 3:
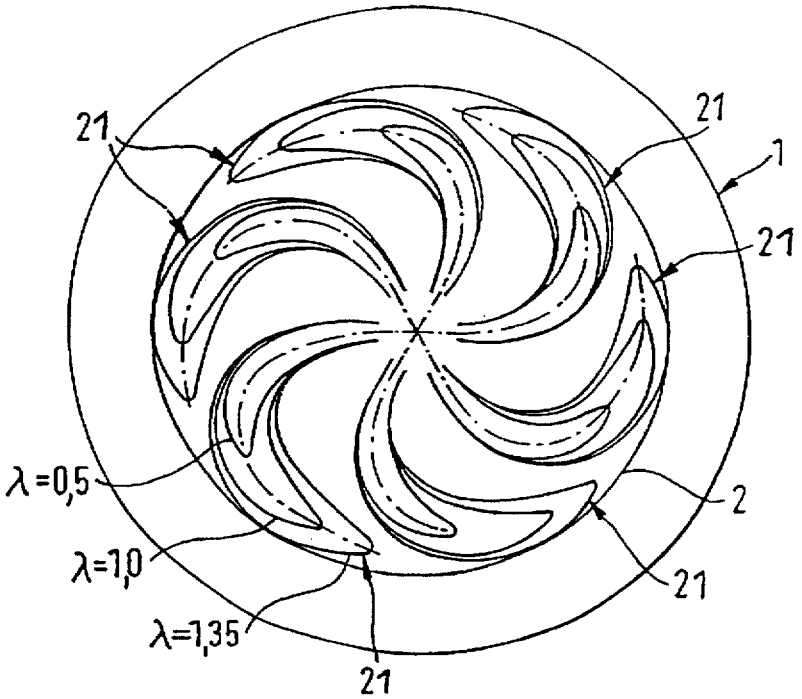
FIG. 3 PRIOR ART
FIG. 3 is a top view of the injection pattern of a conventional multihole nozzle.

FIG. 3 illustrates an injection pattern as it is formed in the case of conventional injection nozzles with injection openings, in this case, 6 in number, which each have the same in size. The diameters of these injection bores are selected in such a manner that the individual drifting sprays 21 do not mutually overlap. However, as easily recognizable in FIG. 3, in the regions between two adjacent injection sprays, areas are formed in each case in which no fuel is mixed with air. The air which is present in these areas is therefore also not utilized during the combustion.

This is where the invention applies because, as illustrated in FIG. 4, one smaller injection spray 23 respectively which forms at the outlet of the small injection opening 9, 16 leads into these gaps between two adjacent injection sprays 22.

According to the intensity of the air swirl, the diameters of the injection openings are adapted to one another in such a manner that, in the drifted condition, the large and small injection sprays 22, 23 complete one another to form an injection pattern which correspondingly completes the areas without any mutual overlapping.

The injection pattern illustrated in FIG. 4 is achieved, for example, by means of an injection nozzle, as illustrated in FIG. 2*a*.

For embodiments in which a very strong air swirl is provided into the combustion space, the embodiment of the injection nozzle according to the invention illustrated in FIG. 2*b* results in an additional improvement. In the case of this embodiment, the large injection openings and the small injection openings are each arranged in pairs uniformly distributed along the overall circumference of the injection nozzle 4.

As a result of the small angular distance 19 of the injection opening axes 17 and 18 of this pair of openings, the smaller injection spray respectively is deflected virtually on the sheltered side of the large injection spray without any overlapping of the lobe-shaped injection sprays. On the other hand, each pair of injection sprays has a combustion space sector available which is larger than the injection pattern illustrated in FIG. 4 and in which the fuel can be drifted without mixing with the adjacent pair of injection sprays. These advantagerous effects of this embodiment can be realized for angular distances 19 in the ranges of 30% to 50% of the angular distance 20 between two adjacent first size injection openings 8, 15.

As indicated by a comparison of the injection pattern according to FIG. 3 and the pattern according to FIG. 4, the injection nozzle according to the invention therefore permits a significantly more surface-covering utilization of the combustion air in the combustion space.

Figure 5:
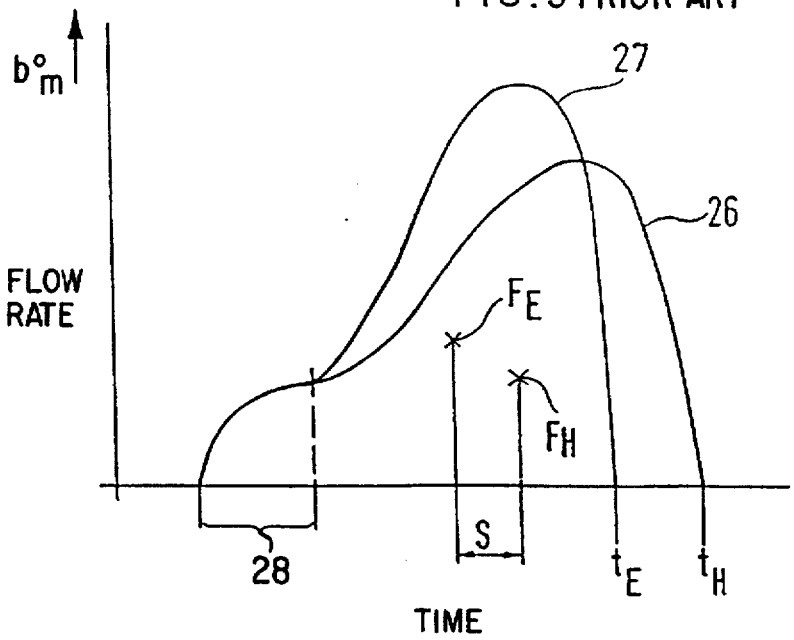
FIG. 5 PRIOR ART
FIG. 5 is a representation of the injection rate over time with the present invention in comparison to conventional injection rates.

Apart from the surface-covering injection form, in the case of the injection nozzle according to the invention, a considerably larger overall cross-sectional surface of the injection openings is available, whereby the respective required fuel quantity can be injected into the combustion space within a much shorter time period. This larger mass flow or flow rate $b_m$ is illustrated in FIG. 5 as a function of the time during an overall injection operation. In this diagram, the curve 26 represents the inflow rate of a conventional injection nozzle, and the course of the curve 27 is the injection rate, as it is possible by means of the injection nozzle according to the invention. The area enclosed under the respective curve 26, 27 and the time axis corresponds to the amount of the injected fuel.

When the injection nozzle is completely open, after a premix range 28, the injection nozzle according to the invention, in contrast to conventional nozzles, permits a significantly steeper rise of the flow rate to a clearly higher maximal value. In addition, because of the larger overall hole cross-section, the injection operation by means of the injection nozzle 4 according to the invention is completed much earlier at time $t_E$ than in the case of conventional injection nozzles at time $t_H$. As a result of this comparison, the center of gravity $F_E$ of the surface of the inflow rate of the nozzle according to the invention is clearly shifted toward the front by the path s in comparison to the center of gravity $F_H$ of conventional nozzles.

Therefore, by means of the injection nozzle 4 according to the invention, a larger amount of fuel can be injected into the combustion space within a shorter time period without the occurrence of local fuel accumulations in it and therefore of high developments of soot and pollutants because of an insufficient utilization of the air.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Injection nozzle for diesel engines with a directional injection into combustion air in a combustion space displaced with a swirl, which injection nozzle is constructed as a hole-type nozzle with several groups of injection openings arranged at uniform distances and distributed along a circumferential arc of the nozzle, wherein between respective first size injection openings, another second smaller size injection opening is constructed, the mouths of all injection openings being situated on the common circumferential arc, said first and second size injection openings defining respective separate fuel injection flows into the combustion space.

2. Injection nozzle according to claim 1, wherein axes of the first size injection openings are situated on a first common cone envelope surface.

3. Injection nozzle according to claim 2, wherein the second size injection openings are each arranged at half the circumferential angle distance of the circumferential angle distance between the next adjacent first size injection openings.

4. Injection nozzle according to claim 2, wherein, viewed in a swirl direction of fuel, the smaller, second size injection openings are situated in an adjacent manner behind the respective larger first size injection openings, and wherein the circumferential angle distance of the second size smaller injection openings from an adjacent larger size injection opening is smaller than half the circumferential angle distance between adjacent ones of the larger first size injection openings.

5. Injection nozzle according to claim 1, wherein axes of the first size injection openings are situated on a first cone envelope surface, and wherein axes of a second size injection openings are situated on a second cone envelope surface, the cone angle ($\alpha_1$) of the first cone envelope surface being larger than a cone angle ($\alpha_2$) of the second cone envelope surface.

6. Injection nozzle according to claim 5, wherein the second size injection openings are each arranged at half the circumferential angle distance of the circumferential angle distance between the next adjacent first size injection openings.

7. Injection nozzle according to claim 5, wherein, viewed in a swirl direction of fuel, the smaller, second size injection openings are situated behind the respective larger first size injection openings, and wherein the circumferential angle distance of the second size smaller injection openings from an adjacent large size injection opening is smaller than half the circumferential angle distance between adjacent ones of the larger, first size injection openings.

8. Injection nozzle according to claim 1, wherein the second size injection openings are each arranged at half the circumferential angle distance of the circumferential angle distance between the next adjacent first size injection openings.

9. Injection nozzle according to claim 1, wherein, viewed in a swirl direction of fuel, the smaller, second size injection openings are situated behind respective larger first size injection openings, and wherein the circumferential angle distance of the second size smaller injection openings from respective adjacent larger size injection openings is smaller than half the circumferential angle distance between adjacent ones of the larger first size injection openings.

10. Injection nozzle for diesel engines of the type providing directional injection of fuel into swirling combustion air in a combustion space, said injection nozzle being a hole-type nozzle comprising:

a plurality of first size injection openings distributed uniformly around a circumference of the nozzle, and a plurality of second size injection openings distributed uniformly around the circumference of the nozzle, said first and second size injection openings defining respective separate fuel injection flows into the combustion space, wherein said second size injection openings are smaller than said first size injection openings and are located respectively between pairs of the first size injection openings.

11. Injection nozzle according to claim 10, wherein axes of the first size injection openings are situated on a first cone envelope surface, and wherein axes of the second size injection openings are situated on a second cone envelope surface, a cone angle ($\alpha_1$) of the first cone envelope surface being larger than a cone angle ($\alpha_2$) of the second cone envelope surface.

12. Injection nozzle according to claim 11, wherein said first and second size injection openings are disposed on a common circumferential arc of the nozzle.

13. Injection nozzle according to claim 10, wherein said first and second size injection openings are disposed on a common circumferential arc of the nozzle.

* * * * *